US008165986B2

(12) United States Patent
Niu et al.

(10) Patent No.: US 8,165,986 B2
(45) Date of Patent: Apr. 24, 2012

(54) METHOD AND SYSTEM FOR REAL TIME PRODUCTION MANAGEMENT AND RESERVOIR CHARACTERIZATION

(75) Inventors: YuQiang Niu, Beijing (CN); Min He, Beijing (CN); Lin Chen, Stavanger (NO); YinLi Wang, Beijing (CN)

(73) Assignee: Schlumberger Technology Corporation, Sugar Land, TX (US)

( * ) Notice: Subject to any disclaimer, the term of this patent is extended or adjusted under 35 U.S.C. 154(b) by 724 days.

(21) Appl. No.: 12/330,673

(22) Filed: Dec. 9, 2008

(65) Prior Publication Data

US 2010/0145667 A1 Jun. 10, 2010

(51) Int. Cl.
*G06F 15/00* (2006.01)
*G06F 15/18* (2006.01)

(52) U.S. Cl. ..... 706/62

(58) Field of Classification Search ..... None
See application file for complete search history.

(56) References Cited

U.S. PATENT DOCUMENTS

| | | | | |
|---|---|---|---|---|
| 5,583,825 | A * | 12/1996 | Carrazzone et al. | 367/31 |
| 6,480,631 | B2 * | 11/2002 | So et al. | 382/248 |
| 7,069,148 | B2 * | 6/2006 | Thambynayagam et al. | 702/12 |
| 2009/0198477 | A1 * | 8/2009 | Benish et al. | 703/10 |

OTHER PUBLICATIONS

"Deconvolution of Drilling Fluid-Contaminated Oil Samples", F.B. Thomas, E. Shtepani, D.B. Bennion, 2002.*

Viberti et al., "A New Approach for Capitalizing on Continuous Downhole Pressure Data", 2005 SPE Annual Technical Conference and Exhibition, Dallas, Texas, Oct. 9-12, 2005, Copyright 2005, Society of Petroleum Engineers.

Athichanagorn et al., "Processing and Interpretation of Long-term Data from Permanent Downhole Pressure Gauges", 1999 SPE Annual Technical Conference and Exhibition, Houston, Texas, Oct. 3-6, 1999, Copyright 1999, Society of Petroleum Engineers.

UEDA et al, "Wavelets: An Elementary Introduction and Examples", UCSC-CRL 94-97, Jan. 17, 1995.

* cited by examiner

*Primary Examiner* — Jeffrey A Gaffin
*Assistant Examiner* — Luis Sitiriche
(74) *Attorney, Agent, or Firm* — Jianguang Du; Hoffman Warnick LLC

(57) ABSTRACT

The present invention is a system and method for generating predictions for various parameters in a reservoir. The invention includes receiving input data characterizing the reservoir and determining transient areas. The transient areas are determined by receiving data from the reservoir, transforming the data using discrete wavelet transformation to produce transformed data, removing outliers from the transformed data, identifying and reducing noise from in the transformed data and then detecting transient areas in the transformed data. A computer model is produced in response to the transient data and predictions for parameters in the reservoir are determined. These predictions are verified by comparing predictive values with a reservoir model and then the predictions for the various parameters can be used.

17 Claims, 9 Drawing Sheets

METHOD AND SYSTEM FOR REAL TIME PRODUCTION MANAGEMENT AND RESERVOIR CHARACTERIZATION

FIELD OF THE INVENTION

The invention relates generally to real-time reservoir characterization.

BACKGROUND OF THE INVENTION

In the lifecycle of modern production management, permanent downhole gauges (PDG) are used in monitoring well production. A PDG is deployed in the down hole in the well. It measures bottom-hole pressure versus time and the data are transmitted to the surface typically via cable. Because of the alien down-hole environment and the high-recording-frequency, the recorded pressure data is numerous and extremely noisy. Hence, only limited information can be extracted from the data.

FIG. 1 shows the conventional method of dealing with the enormous quantity of high-frequency pressure data recorded from PDG in a reservoir 10. There are two steps, on the left side of FIG. 1, step 1, the production data acquisition process (PDAP) 11 is shown. The PDAP is done automatically as the PDG records pressure continuously. The recorded data is referred as real time (RT) data. RT data can be stored automatically to the server and also be downloaded to the local personal computer (PC). The second step is the production data interpretation process (PDIP) 12 and is shown on the right side of FIG. 1. Typically, trained technical staff or experts have to perform the PDIP 12. After obtaining real-time data, the technical staff or experts manually determine the transient areas (build up area and draw down area, for example). The process is called transient detection. Once the transients are detected, the technical staff interprets the detected transients, based on the pressure data within the chosen transient areas and the flow rate history. From this interpretation, the technical staff determines formation parameters such permeability, well bore storage and skin, which will be deemed as inputs for history matching. Finally, the technical staff run model based history matching. By running history matching, the interpreted formation parameters can be improved to meet the pressure response in reservoir scale. In this step, a numerical simulator is applied. But this step cannot be implemented automatically, because the numerical simulation is always time-consuming and real time data is enormous. Finally, the improved parameters will be used to characterize the reservoir and guide the future production.

The present invention provides real time data collection, interpretation and modeling to provide real time characterization of reservoirs and provide accurate prediction of reservoir properties.

SUMMARY OF THE INVENTION

The present invention is a system and method for generating predictions for various parameters in a reservoir. The invention includes receiving input data characterizing the reservoir and determining transient areas. The transient areas are determined by receiving data from the reservoir, transforming the data using discrete wavelet transformation to produce transformed data, removing outliers from the transformed data, identifying and reducing noise from the transformed data and then detecting transient areas in the transformed data. A computer model is produced in response to the transient data and predictions for parameters in the reservoir are determined. These predictions are verified by comparing predictive values with a reservoir model and then the predictions for the various parameters can be used.

Additional objects and advantages of the invention will become apparent to those skilled in the art upon reference to the detailed description taken in conjunction with the provided figures.

BRIEF DESCRIPTION OF THE DRAWINGS

The present invention is illustrated by way of example and not intended to be limited by the figures of the accompanying drawings in which like references indicate similar elements and in which.

DETAILED DESCRIPTION OF THE INVENTION

Measurement channels from current permanent downhole gauges (PDG) may include pressures and temperatures. The large volume of data requires significant bandwidth to transmit and to analyze.

Figure 1:
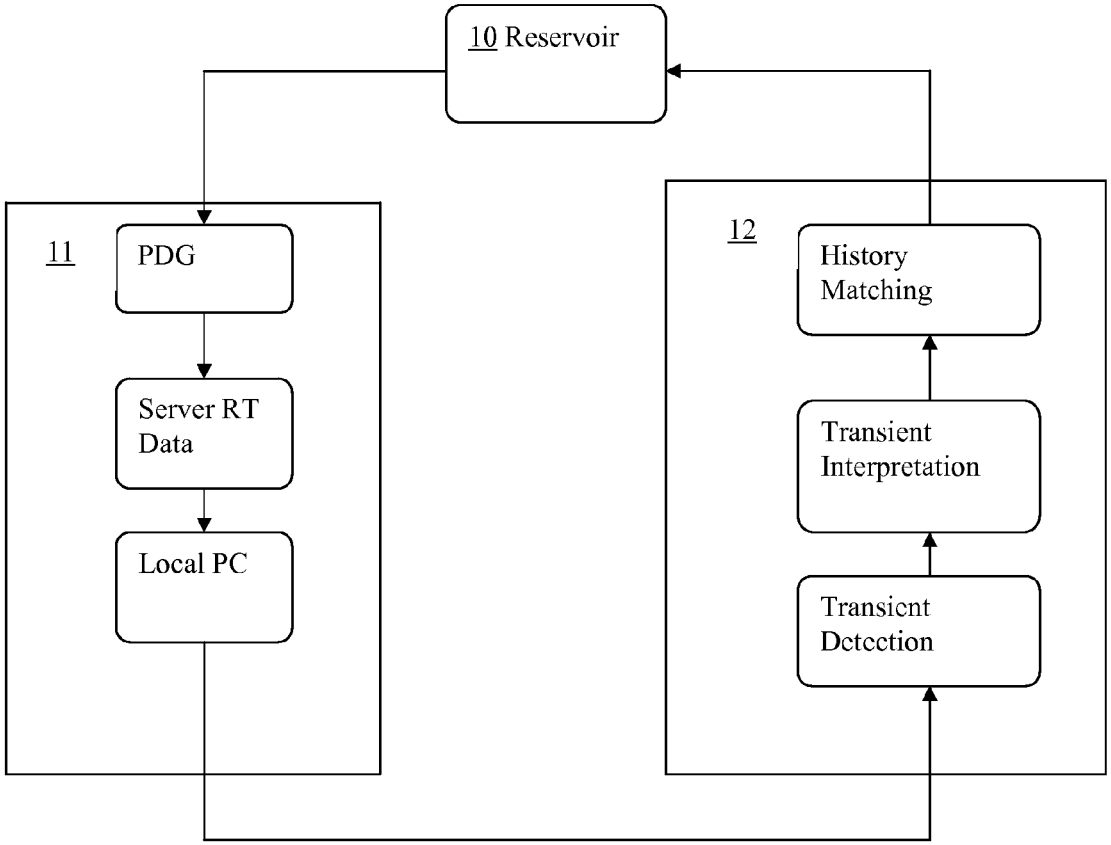
FIG. 1 is a block diagram of the prior art method of retrieving using data to make predictions for parameters in a reservoir.
Figure 2:
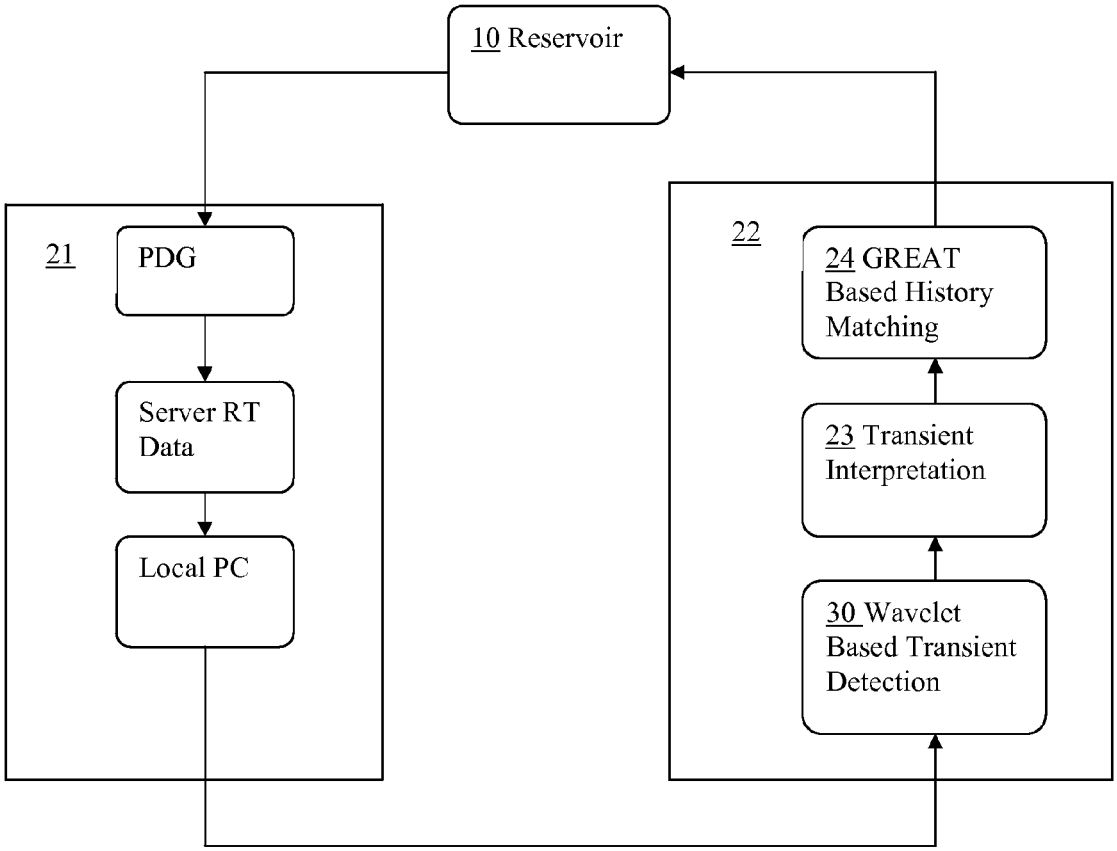
FIG. 2 is a block diagram of the method of the present invention.

FIG. 2 shows how the invention deals with the PDG data automatically from reservoir 10 from production data acquisition process (PDAP) 21 to production data interpretation process (PDIP) 22. The difference lies in PDIP 22. First, wavelet based transient detection 30 is introduced to implement automatic transient detection. The transients are interpreted 23 and a fast simulator is applied to implement history matching 24, which meets the requirements of carrying out reservoir simulation in real time. The above simulator can be semi-analytical or analytical. An example of this is the GREAT as described in U.S. Pat. No. 7,069,148, incorporated by reference herein.

Wavelet based transient detection applies wavelet analysis methods. It covers three steps: Outlier removal which removes the outliers in the signal; Denoising which reduces the noise in the signal; and Transient Detection which detects the transient areas in the signal.

Wavelets were developed in the signal analysis field and present a wide range of applications in the petroleum field such as pressure data denoising and transient identification. Wavelets are associated with scaling functions. Wavelets and the associated scaling functions are basis functions and can be used to represent the signal. One can analyze and reconstruct the signal by analyzing and modifying the wavelet coefficient and scaling coefficients, which is calculated via the discrete wavelet transform (DWT). DWT can decompose the signal to certain decomposition levels, which is defined by the data point of the signal. If the signal has $2^J$ values, J is defined as the maximum decomposition level. A general introduction to DWT is given by Mallat, "*A Theory for Multiresolution Signal Decomposition: The Wavelet Representation*," IEEE Trans. Pattern Analysis and Machine Intelligence (July 1989) vol. 11, no. 7, p. 674. A further description is found in PCT/US2008/07042 filed 18 Jul. 2008, incorporated by reference herein.

A data processing method that involves using a low-pass filter and a high-pass filter to decompose the dataset into two subsets is described. A one dimensional vector may be referred to as $S^{obs}$. The vector $S^{obs}$ may be decomposed using a low-pass filter G to extract a vector C or using a high pass filter H to extract a vector D. The vector C represents the low-frequency, or average, behavior of the signals, while the vector D represents the high frequency behavior of the signals.

Unlike Fourier Transforms, which use periodic waves, Wavelet Transforms use localized waves and are more suitable for transient analysis because different resolutions at different frequencies are possible. The filters H and G mentioned above are derived from Discrete Wavelet Transformations (DWT). DWT is the most appropriate for removing the types of random noise and other distortions in signals generated by formation testers. In some cases, when DWT is not the most appropriate approach to the generation of filters H and G mentioned above, other approaches such as Fourier Transformations may be used.

When a DWT is applied, the vector D described above contains the wavelet coefficients (WC's) and the vector C described above contains the scaling function coefficients (SC's). The basic DWT may be illustrated by the following equations (1) and (2):

$$D_{HIGH}(n) = \sum_{k=-\infty}^{\infty} S(k)H(n-k), \tag{1}$$

$$C_{LOW}(n) = \sum_{k=-\infty}^{\infty} S(k)G(n-k). \tag{2}$$

For efficient DWT, the signal S(k) should contain $2^j$ data values. A vector S having $2^j$ values is referred to as vector of level j. The vectors C and D shown above each will contain $2^{j-1}$ values, and, therefore, they are at level j−1. Thus, the DWT shown in equations (1) and (2) decomposes the input signal S(k) by one level. The decomposition can be iterated down to any desired level.

In accordance with embodiments of the invention, specific types of wavelet functions may be chosen according to the types of data to be processed. Commonly used wavelet functions include Haar, Daubechies, Coiflet, Symlet, Meyer, Morlet, and Mexican Hat. In accordance with some embodiments of the invention, the Haar wavelet functions are used to detect discrete events, such as the presence of gas bubbles and the start of pressure transients (such as the start of drawdown and buildup), while the Daubechies wavelets are used to detect trends in the signals because these wavelets can generate smooth reconstructed signals.

For H and G derived from DWT, de-noising algorithms may be chosen to be specific to the wavelets used in the DWT. In accordance with some embodiments of the invention, algorithms based-on local maxima may be used to remove white noise. These algorithms have been described in Mallat and Hwang, "*Singularity Detection and Processing with Wavelets*," IEEE Trans. Info. Theory (1992) vol. 38, no. 2, p. 617.

In accordance with some embodiments of the invention, threshold-based wavelet shrinkage algorithms may be used for noise reduction. These algorithms are given in David L. Donoho and lain M. Johnstone, "Ideal Spatial Adaptation via Wavelet Shrinkage," Biometrika, 81(3), 425-455 (1994).

In accordance with some embodiments of the invention, the algorithms that are most appropriate for denoising a signal may be chosen after appropriate statistical techniques (tools) have been applied to identify the structure of the noises. Such statistical tools, for example, may include histograms of the wavelet coefficients which provide understanding of the spread and mean of the noises, and plots of the autocorrelation of the wavelet coefficients, as these provide understanding of the time structure of distortions on the signals.

By running DWT, the wavelet coefficients, which represent the noisy signal, and scaling coefficients, which represent the detailed signal, are gained. By analyzing and filtering the wavelet coefficients for noisy signal and then reconstructing it, the signal can be processed. By applying transient identification methods to the wavelet coefficients of the pressure signal, the transient events (drawdown/buildup) can be detected.

Figure 3:
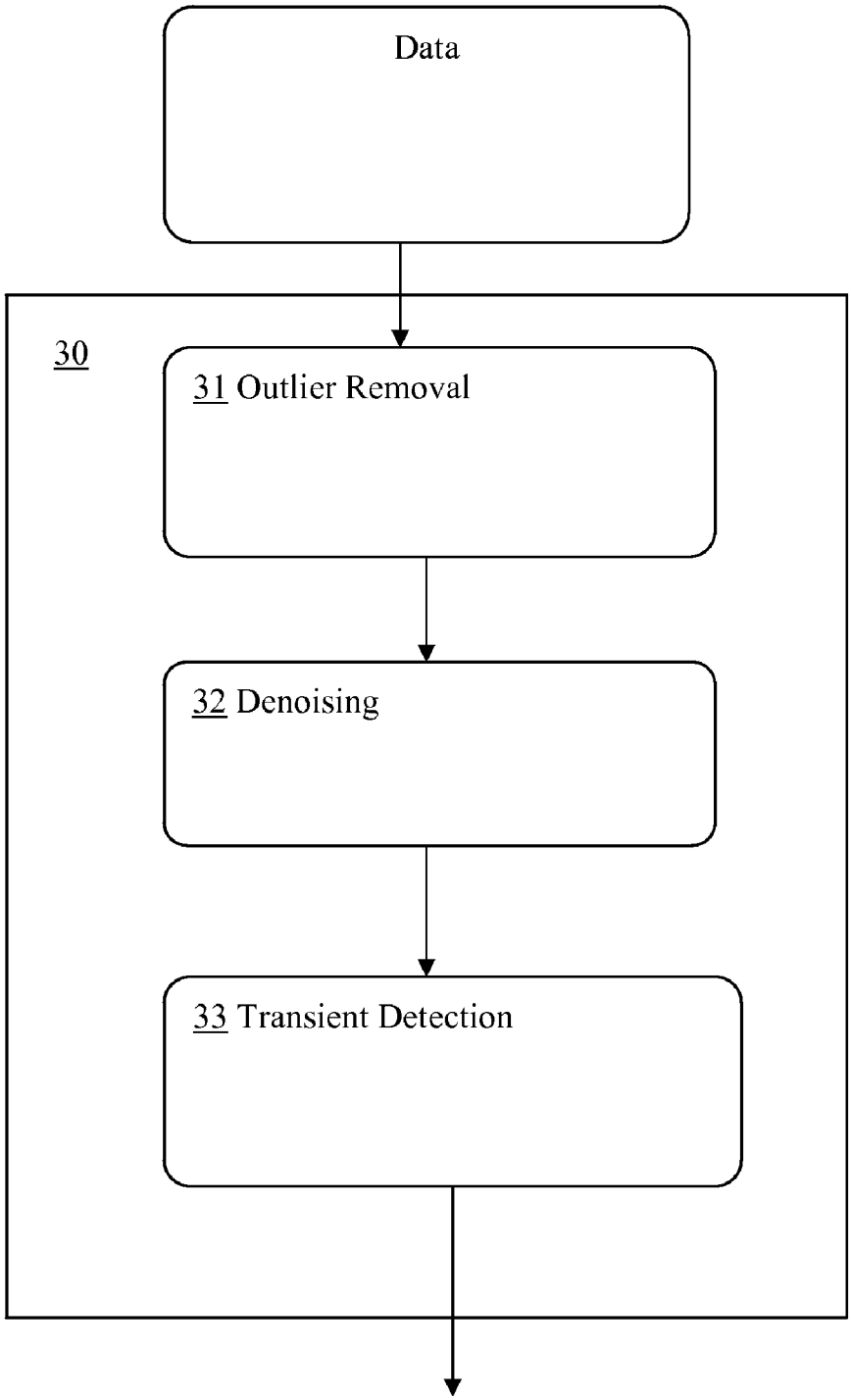
FIG. 3 is a block diagram of the method of automatically detecting transients used in the present invention.

To implement wavelet based transient detection 30 to production data, it is necessary to follow the steps, outlier removal 31, denoising 32 and transient detection 33 as FIG. 3 shows:

1. Outlier Removal (31, FIG. 2)

Figure 4:
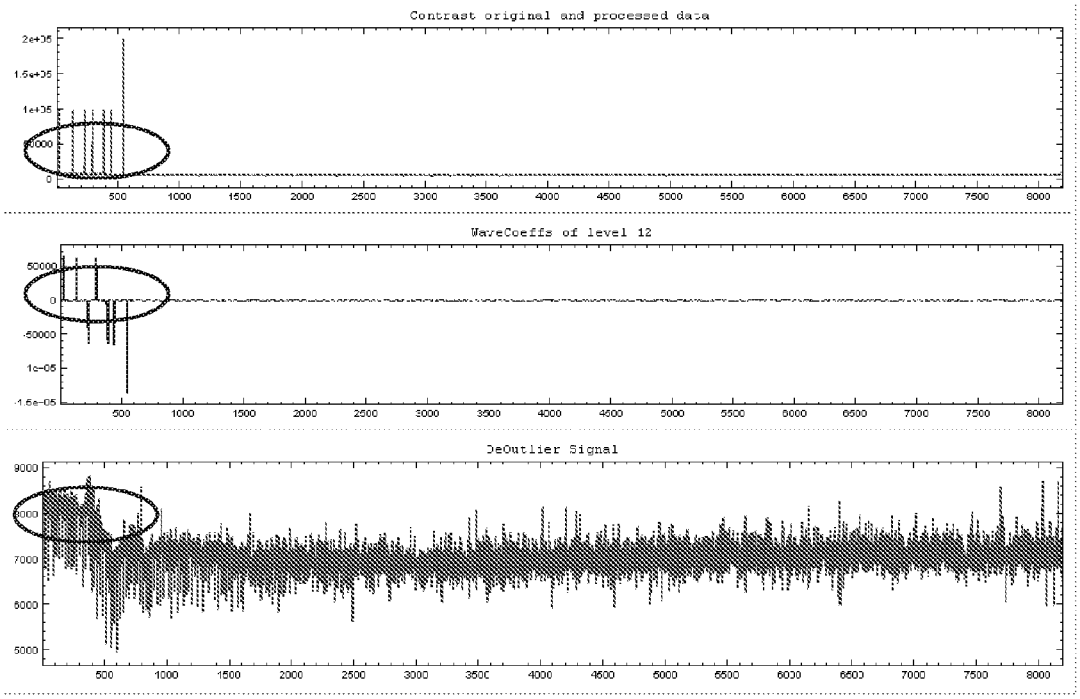
FIG. 4 is a series of signals showing outlier removal using discrete wavelet transformation, the upper plot showing the raw signal with outliers (scaled 0-200,000), the middle plot showing wavelet coefficients, the lower plot showing the outlier removed signal (scaled 500-9000)

Outliers are common phenomena in the signal domain. They are large-amplitude, short lived distortions to the signals and cause discontinuities in the data stream. But they can be recognized in the wavelet coefficient of the $1^{st}$ step of decomposition as FIG. 4 shows. Discrete wavelet transforms (DWT) are used to identify outliers by their "outlying" distributions of the wavelet coefficients (WC's). In the upper plot of FIG. 4 the raw signal is scaled from 0-20,000 and the outliers are shown. There are 8092 ($2^{13}$) points, so the maximum decomposition level is 13. The wavelet coefficients at decomposition level 12 (shown in middle plot of FIG. 4) indicate the position of outliers clearly. By running DWT and the outlier removal method, the outliers are completely removed (lower plot of FIG. 4).

2. Denoising (32, FIG. 2)

Figure 5:
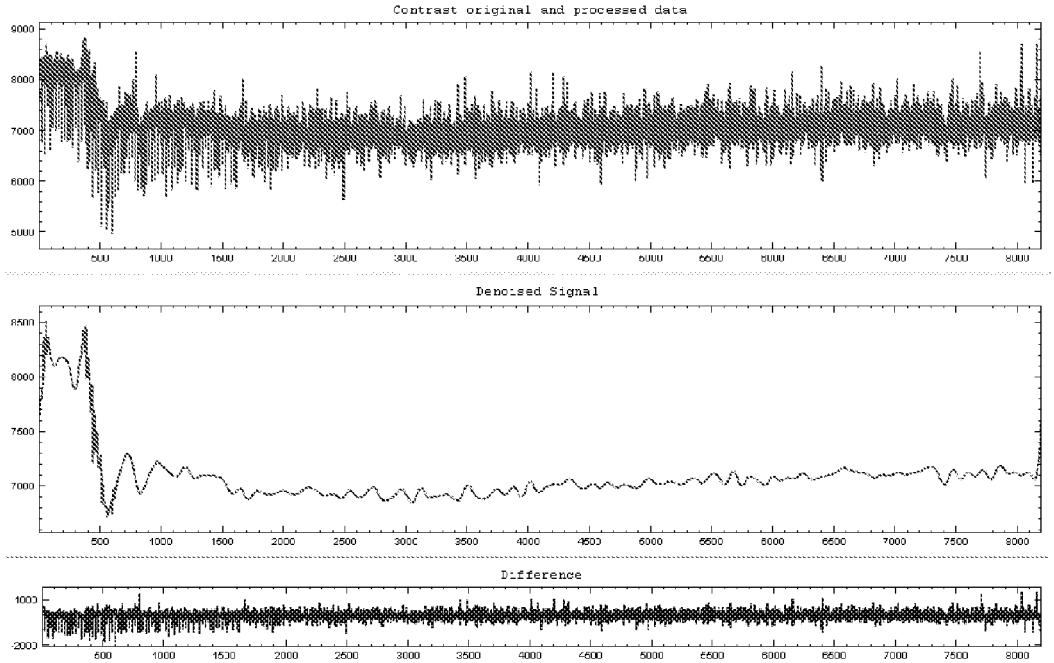
FIG. 5 is a series of signals showing noise reduction from the signal in FIG. 4, the upper plot showing the raw signal with an overlay of the denoised results, the middle plot showing the denoised results, and the lower plot showing the difference between the two signals indicating the amount of noise reduction.

Noise is another common phenomenon in signal domain. It has low magnitude and exists at all levels of decomposition. It can be detected at lower levels as the upper plot of FIG. 5 shows. By running DWT and the denoising method, the noise can be largely removed. To facilitate noise identification and removal, embodiments of the invention convert (or transform) measurement data, using a proper transformation function, into a dimension/domain different from the original dimension/domain such that the signals and the noises have different characteristics. For example, time domain data may be converted into frequency domain data, or vice versa, by Fourier Transformation (FT). In the frequency domain, the signals can typically be identified as peaks at discrete frequencies with significant amplitudes, while the noises typically spread all over the frequency range and have relatively low amplitudes. Therefore, the signals and noises that commingle in the time domain may become readily discernable in the frequency domain. Wavelet transforms operate by a similar principle: time domain data is converted to wavelet domain data, then distortions are easily identified and removed.

After the transformation, the noises or distortions are identified and removed (middle plot of FIG. 5). One of ordinary skill in the art would appreciate that the exact methods for identifying and removing the noises may depend on the transform functions used. For example, time-series data may be transformed using a discrete wavelet transform to permit the distinction between the signals and noises (or other distortions). After a discrete wavelet transform, the true signals associated with a gradually changing process will manifest themselves as wavelets having coefficients that cluster in a normal distribution. On the other hand, noises or distortions would likely have coefficients that do not belong to the same group as the signals. Therefore, noises and distortions can be identified by their unique distribution of wavelet coefficients. The lower plot of FIG. 5 shows the difference between the upper and middle plots of FIG. 5 and indicates the amount of noise reduction.

3. Transient Detection (33, FIG. 2)

Figure 6:
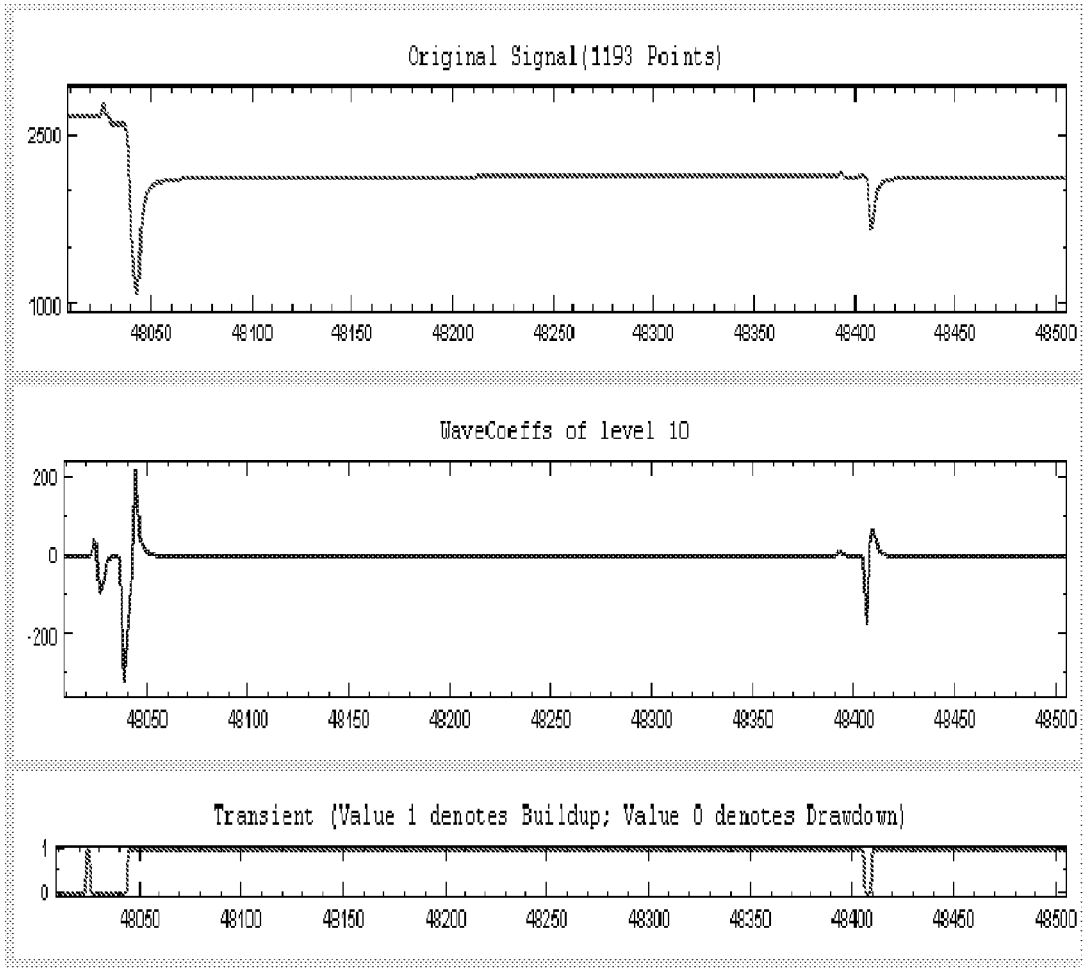
FIG. 6 is a series of signals transient identification from the signal in FIG. 5, the upper plot showing the raw (outlier and denoised) signal, the middle plot showing the wavelet coefficients, and the lower plot showing the detection results with drawdown period indicted as zero (0) and buildup periods indicated as one (1)

After removing outliers and reducing noise, it is easy to detect the transient areas with transient detection methods. FIG. 6 shows how the transient areas are detected. Here, 1 and 0 are used as indicators: 1 indicating build up and 0 indicating draw down.

Figure 7:
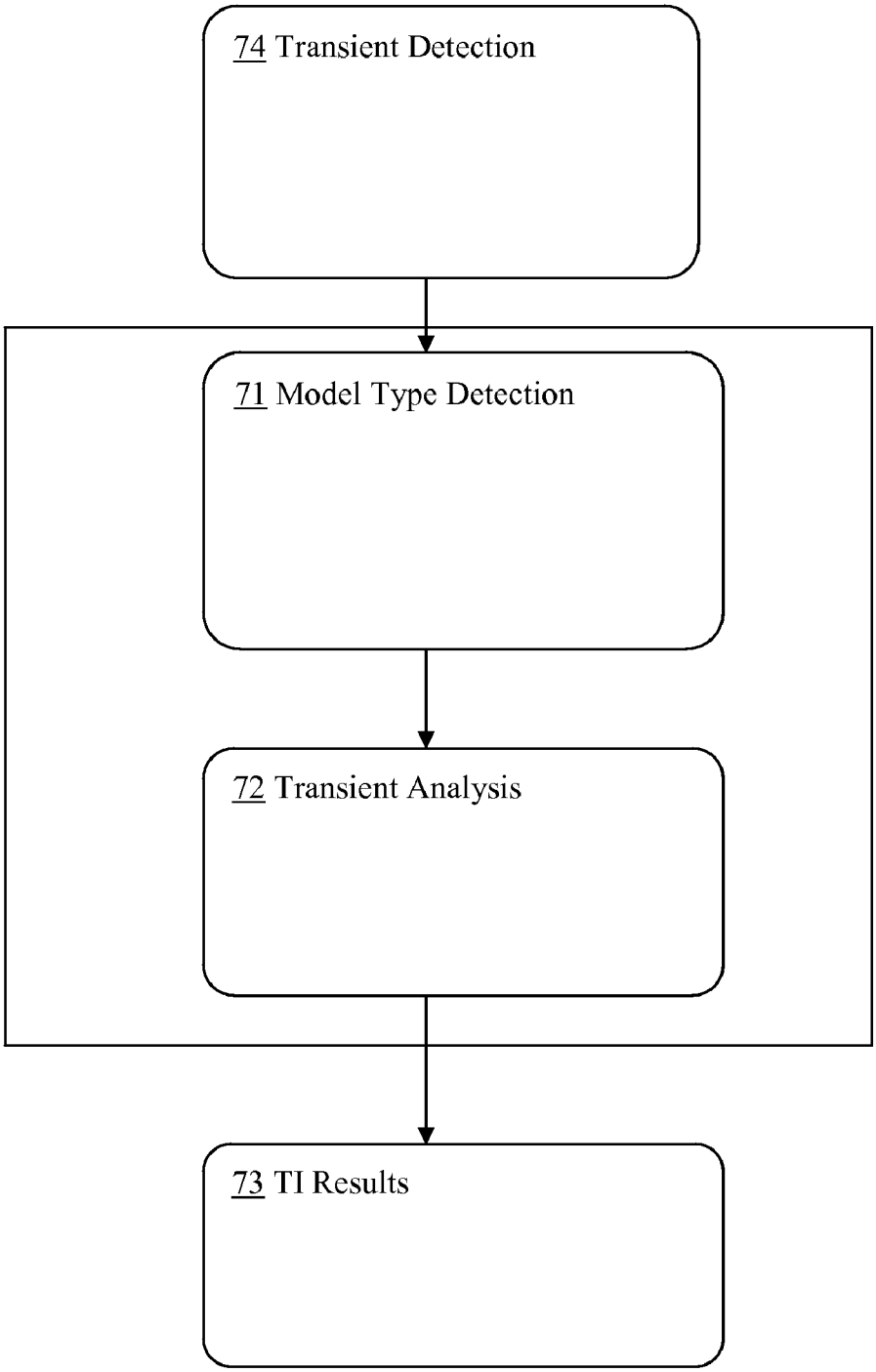
FIG. 7 is a block diagram of the method of automatically selecting a reservoir model to perform transient analysis.

Interpretation of the detected transient is performed automatically. To do this a Neural Network system is used to determine the appropriate reservoir model. Standard techniques well known in the industry are applied to interpret the data in the confines of the model and deliver reservoir parameters. FIG. 7 shows the appropriate reservoir model being selected 71 automatically and the transient analysis 72 being performed after being fed the transient detection data 74. The output from this is the transient interpretation results 73. These reservoir parameters 73 are used as the input to the history matching in the next step.

History matching applies a fast simulator starting with the output parameters from the transient interpretation. These parameters are optimized interactively with the complete production history of the reservoir. It is possible to update the reservoir models which are renewed with the coming of real time data.

U.S. Pat. No. 7,069,148, describes the Gas Reservoir Evaluation and Assessment Tool (GREAT) which is a semi-analytical simulation method for reservoir simulation. It is fast and accurate in dealing with complex formation problems. This model is used to predict pressure and other production characteristics of a reservoir.

Figure 8:
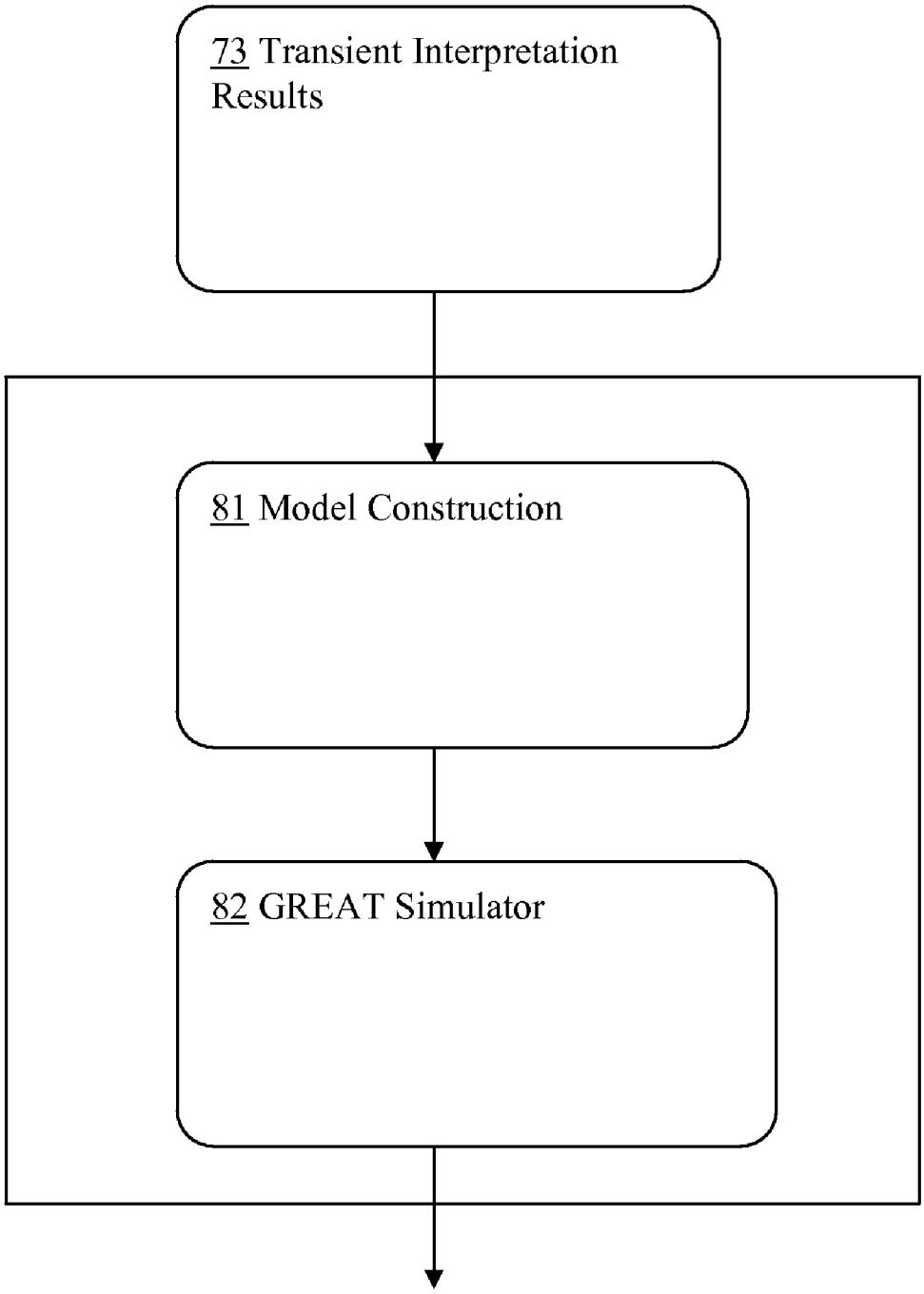
FIG. 8 is a block diagram of the method of automatically using transient interpretation to model reservoir data and history match this with a previous model

To implement GREAT based history matching, it is necessary to follow the steps as FIG. 8 shows:

1. Model Construction (81, FIG. 8)

In this step, the transient interpretation results will be used to construct the GREAT model by incorporating formation geometry, formation fluids, formation production history and computation settings. The model will be used by the GREAT simulator.

2. GREAT Simulation (82, FIG. 8)

GREAT computes the formation pressure over the whole life of well production and carries out automatic history matching. The output will be the improved formation parameters. These parameters will be used to characterize the formation. The fast speed of the GREAT simulation engine allows these computations to be completed in real time.

The GREAT simulation receives input data pertaining to a reservoir. It then creates a model and matches the predictive model values with real-time data. This is accomplished by calculating the reservoir model predictive values in one dimension associated with a single layer in said reservoir, each of the reservoir model predictive values existing a single point in space in the reservoir and at a single point in time in the reservoir. The next step is to calculate the reservoir model predictive values in one dimension associated with multiple layers in the reservoir, each of the reservoir model predictive values in one dimension existing at a single point in space in the reservoir and at a single point in time in the reservoir. Then GREAT calculates the reservoir model predictive values in three dimensions associated with multiple layers in said reservoir, each of the reservoir model predictive values in each of said multiple layers in three dimensions existing at a single point in space in the reservoir and at a single point in time is the reservoir. Finally GREAT calculates the reservoir model predictive values in three dimensions as a function of time, the values being associated with multiple layers in the reservoir, each of the reservoir model predictive values in each of the multiple layers in three dimensions existing as a single point in space in said reservoir, each of the reservoir model predictive values in the multiple layers in three dimensions existing at any future point in time in said reservoir. The computer model is verified through history matching of the reservoir model predictive values. This is a preferred method of computer modeling although other embodiments are possible.

The efficiency of analytical models is generally judged by accuracy and speed. The novel set of solutions used in the GREAT tool is applicable to multiple wells, which can be vertical as well as horizontal. These wells can be operating as producers or injectors thus being of additional significance to gas well storage. The solutions have been derived by application of successive integral transforms. The application of these new solutions is characterized by stability and speed.

By introducing wavelet analysis methods, which process recorded pressure data by removing outlier and denoising, it is possible to detect the transient areas, which is defined as draw-down area and build-up area. By applying well test methods to the pressure data of transient areas, the useful information, such as permeability, well bore storage and skin, can be derived. Then newly developed analytical simulator is applied to improve the reservoir model by executing history matching.

There is illustrated a computer system 900 for generating a prediction of values in a reservoir in accordance with the present invention. Computer system 900 is intended to represent any type of computerized system capable of implementing the methods of the present invention. For example, computer system 900 may comprise a desktop computer, laptop, workstation, server, PDA, cellular phone, pager, etc.

Data generated by PDG is received and stored by computer system 900, for example, in storage unit 902, and/or may be provided to computer system 900 over a network 904. Storage unit 902 can be any system capable of providing storage for data and information under the present invention. As such, storage unit 902 may reside at a single physical location, comprising one or more types of data storage, or may be distributed across a plurality of physical systems in various forms. In another embodiment, storage unit 902 may be distributed across, for example, a local area network (LAN), wide area network (WAN) or a storage area network (SAN) (not shown).

Network 904 is intended to represent any type of network over which data can be transmitted. For example, network 904 can include the Internet, a wide area network (WAN), a local area network (LAN), a virtual private network (VPN), a WiFi network, or other type of network. To this extent, communication can occur via a direct hardwired connection or via an addressable connection in a client-server (or server-server) environment that may utilize any combination of wireline and/or wireless transmission methods. In the case of the latter, the server and client may utilize conventional network connectivity, such as Token Ring, Ethernet, WiFi or other conventional communications standards. Where the client communicates with the server via the Internet, connectivity could be provided by conventional TCP/IP sockets-based protocol. In this instance, the client would utilize an Internet service provider to establish connectivity to the server.

Figure 9:
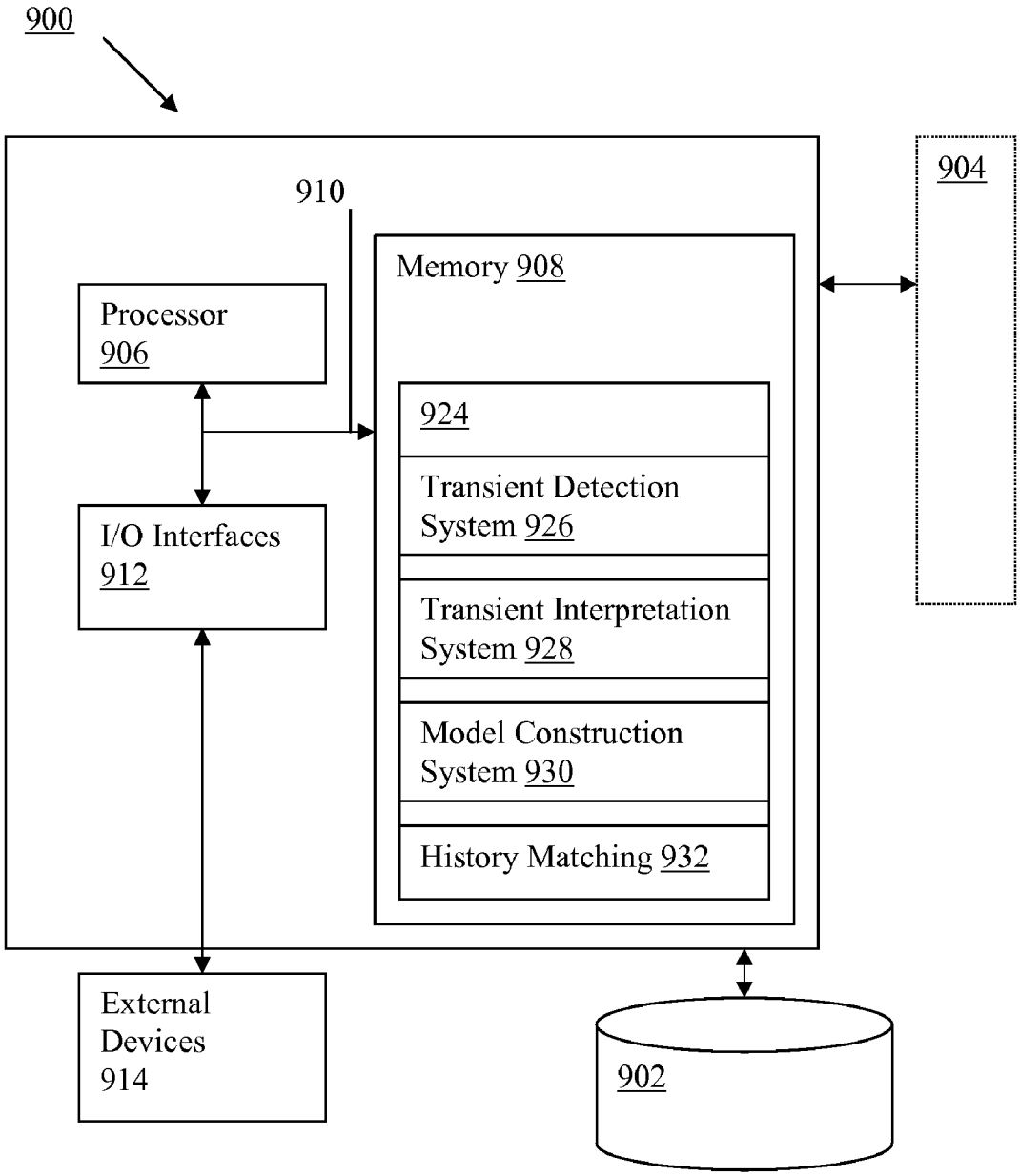
FIG. 9 is block diagram of a computer system used in an embodiment of the present invention.

As shown in FIG. 9, computer system 900 generally includes a processor 906, memory 908, bus 910, input/output (I/O) interfaces 912 and external devices/resources 914. Processor 906 may comprise a single processing unit, or may be distributed across one or more processing units in one or more locations, e.g., on a client and server. Memory 908 may comprise any known type of data storage and/or transmission media, including magnetic media, optical media, random access memory (RAM), read-only memory (ROM), etc. Moreover, similar to processor 406, memory 408 may reside at a single physical location, comprising one or more types of data storage, or be distributed across a plurality of physical systems in various forms.

I/O interfaces 912 may comprise any system for exchanging information to/from an external source. External devices/resources 914 may comprise any known type of external device, including speakers, a CRT, LED screen, handheld device, keyboard, mouse, voice recognition system, speech output system, printer, monitor/display (e.g., display 916), facsimile, pager, etc.

Bus 910 provides a communication link between each of the components in computer system 900, and likewise may comprise any known type of transmission link, including electrical, optical, wireless, etc. In addition, although not shown, additional components, such as cache memory, communication systems, system software, etc., may be incorporated into computer system 900.

Shown in memory 908 is a prediction system 924 for predicting values in a reservoir from the real time data in accordance with the present invention, which may be provided as computer program product. Prediction system 924 includes a transient detection system 926 for identifying transients, an transient interpretation system 928 for interpreting transients, and model construction system 930 for constructing a model. Memory 908 includes history matching system 932 for matching the predicting models with real time data to further refine the model.

It should be appreciated that the teachings of the present invention could be offered as a business method on a subscription or fee basis. For example, computer system 900 could be created, maintained, supported, and/or deployed by a service provider that offers the functions described herein for customers. It should also be understood that the present invention can be realized in hardware, software, a propagated signal, or any combination thereof. Any kind of computer/server system(s)—or other apparatus adapted for carrying out the methods described herein—is suited. A typical combination of hardware and software could be a general purpose computer system with a computer program that, when loaded and executed, carries out the respective methods described herein. Alternatively, a specific use computer, containing specialized hardware for carrying out one or more of the functional tasks of the invention, could be utilized. The present invention can also be embedded in a computer program product or a propagated signal, which comprises all the respective features enabling the implementation of the methods described herein, and which—when loaded in a computer system—is able to carry out these methods. Computer program, propagated signal, software program, program, or software, in the present context mean any expression, in any language, code or notation, of a set of instructions intended to cause a system having an information processing capability to perform a particular function either directly or after either or both of the following: (a) conversion to another language, code or notation; and/or (b) reproduction in a different material form.

As used herein, it is understood that the terms "program code" and "computer program code" are synonymous and mean any expression, in any language, code or notation, of a set of instructions that cause a computing device having an information processing capability to perform a particular function either directly or after any combination of the following: (a) conversion to another language, code or notation; (b) reproduction in a different material form; and/or (c) decompression. To this extent, program code can be embodied as one or more types of program products, such as an application/software program, component software/a library of functions, an operating system, a basic I/O system/driver for a particular computing and/or IPO device, and the like. Further, it is understood that terms such as "component" and "system" are synonymous as used herein and represent any combination of hardware and/or software capable of performing some function(s).

The block diagrams in the figures illustrate the architecture, functionality, and operation of possible implementations of systems, methods and computer program products according to various embodiments of the present invention. In this regard, each block in the block diagrams may represent a module, segment, or portion of code, which comprises one or more executable instructions for implementing the specified logical function(s). It should also be noted that the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams can be implemented by special purpose hardware-based systems which perform the specified functions or acts, or combinations of special purpose hardware and computer instructions.

In the instant invention the methods and apparatus of implementing automatic production management and data interpretation are improved by integrating wavelet based transient detection and GREAT based history matching. By using this apparatus, the real time production management can be implemented in automatic manner.

This enables automatic production management process and automatic pressure interpretation. Furthermore, it can incorporate alarming mechanism, which sends alarms or warning messages to the experts in real time.

The invention has been described in detail with particular reference to certain preferred embodiments thereof, but it will be understood that variations and modifications can be effected within the spirit and scope of the invention.

What is claimed is:

1. A method for generating a prediction of values in a reservoir comprising:

a) receiving input data characterizing the reservoir;

b) obtaining transient areas:

i) receiving data from the reservoir;

ii) transforming the input data using discrete wavelet transformation to produce transformed data;

iii) removing outliers from the transformed data;

iv) identifying and reducing noise from in the transformed data;

v) detecting transient areas in the transformed data;

c) producing a computer model in response to said input data including performing history matching on detected transient areas;

d) verifying the computer model through history matching and determining predictive values of the reservoir; and e) outputting predictive values.

2. The method of claim 1, wherein the identifying and reducing noise is by analyzing distribution of wavelet coefficients.

3. The method of claim 1, further comprising compressing the transformed data.

4. The method of claim 3, wherein compressing the transformed data uses a wavelet transform.

5. The method of claim 1, wherein verifying the computer model through history matching comprises:

(i) receiving input data characterizing a reservoir;

(ii) producing the reservoir model in response to said input data representing said reservoir in multi dimensions.

6. The method of claim 5 wherein the producing the reservoir model includes the steps of:

calculating the oil based mud contamination of a hydrocarbon fluid obtained from a wellbore in one dimension associated with a single layer in said reservoir, each of the oil based mud contamination existing at a single point in space in said reservoir and at a single point in time in said reservoir, calculating the oil based mud contamination in said one dimension associated with multiple layers in said reservoir, each of the oil based mud contamination in each of said multiple layers existing at a single point in space in said reservoir and at a single point in time in said reservoir, calculating the oil based mud contamination in three dimensions associated with said multiple layers in said reservoir, each of the oil based mud contamination in each of said multiple layers in said three dimensions existing at a single point in space in said reservoir and at a single point in time in said reservoir, calculating the oil based mud contamination in said three dimensions as a function of time, said values being associated with said multiple layers in said reservoir, each of the oil based mud contamination in each of said multiple layers in said three dimensions existing at a single point in space in said reservoir, said each of the oil based mud contamination in said each of said multiple layers in said three dimensions existing at any future point in time in said reservoir, said reservoir model being produced in response to the calculating the oil based mud contamination in said three dimensions.

7. A system for data processing to predict values in a reservoir, comprising a processor and a memory wherein the memory stores a program having instructions for:

a) receiving input data characterizing the reservoir;

b) obtaining transient areas:

i) receiving data from the reservoir;

ii) transforming the pressure data using discrete wavelet transformation to produce transformed data;

iii) removing outliers from the transformed data;

iv) identifying and reducing noise from in the transformed data;

v) detecting transient areas in the transformed data;

c) producing a computer model in response to said input data including performing history matching on detected transient areas;

d) verifying the computer model through history matching and determining predictive values of the reservoir; and e) outputting predictive values.

8. The system of claim 7, wherein the identifying the distortions is by analyzing distribution of wavelet coefficients.

9. The system of claim 7, further comprising compressing the transformed data.

10. The system of claim 9, wherein compressing the transformed data uses a wavelet transform.

11. The system of claim 7, wherein verifying the computer model through history matching comprises:

(i) receiving input data characterizing a reservoir; and (ii) calculating the reservoir model in response to said input data characterizing reservoir wherein the input data is in multi-dimensions.

12. The system of claim 11, wherein calculating the reservoir model comprises:

calculating model predictive values in one dimension associated with a single layer in said reservoir, each of the reservoir model predictive values existing at a single point in space in said reservoir and at a single point in time in said reservoir;

calculating the reservoir model predictive values in said one dimension associated with multiple layers in said reservoir, each of the reservoir model predictive values existing at a single point in space in said reservoir and at a single point in time in said reservoir;

calculating the reservoir model predictive values in three dimensions associated with said multiple layers in said reservoir, each of the reservoir model predictive values in each of said multiple layers in said three dimensions existing at a single point in space in said reservoir and at a single point in time is said reservoir;

calculating the reservoir model predictive values in said three dimensions as a function of time, said values being associated with said multiple layers in said reservoir, each of the reservoir model predictive values in each of said multiple layers in said three dimensions existing as a single point in space in said reservoir, each of the reservoir model predictive values in said each of said multiple layers in said three dimensions existing at any future point in time in said reservoir; and comparing the reservoir model predictive values in each of said multiple layers in said three dimensions with predictive values.

13. The system of claim 7, wherein the system is disposed in a permanent downhole gauge.

14. A non-transitory computer readable medium having a computer program product stored thereon for enabling a computer to predict values in a reservoir which when executed by a computer comprises:

a) receiving input data characterizing the reservoir;

b) obtaining transient areas by;

i) receiving data from the reservoir;

ii) transforming the pressure data using discrete wavelet transformation to produce transformed data;

iii) removing outliers from the transformed data iv) identifying and reducing noise from in the transformed data;

v) detecting transient areas in the transformed data;

c) producing a computer model in response to said input data including performing history matching on detected transient areas;

d) verifying the computer model through history matching and determining predictive values of the reservoir; and e) using predictive values.

15. The non-transitory computer readable medium of claim 14, wherein the identifying and reducing noise is by analyzing distribution of wavelet coefficients.

16. The non-transitory computer readable medium of claim 14, further comprising compressing the transformed data.

17. The non-transitory computer readable medium of claim 16, wherein the compressing the transformed data uses a wavelet transform.

* * * * *